US005499580A

United States Patent [19]

Hoffmann et al.

[11] Patent Number: 5,499,580

[45] Date of Patent: Mar. 19, 1996

[54] PROCESS FOR FABRICATING A SLEEVE SHAPED PRINTING FORM

[75] Inventors: Eduard Hoffmann, Bobingen; Johann Winterholler, Friedberg; Wolfgang Prem, Kutzenhausen, all of Germany

[73] Assignee: MAN Roland Druckmaschinen AG, Offenbach am Main, Germany

[21] Appl. No.: 333,216

[22] Filed: Nov. 2, 1994

[30] Foreign Application Priority Data

Nov. 11, 1993 [DE] Germany ..... 43 38 467.6

[51] Int. Cl.[6] ..... B41N 1/16; B21C 37/08

[52] U.S. Cl. ..... 101/375; 101/DIG. 36; 29/895.3; 72/368; 219/121.64; 219/121.72; 228/17.5

[58] Field of Search ..... 101/216, 375, 101/378, 382.1, 389.1, 395, 401.1, 415.1, 485, 486, DIG. 36; 219/121.63, 121.64, 121.67, 121.70, 121.71, 121.72; 228/5.7, 13, 17.5; 72/368; 492/18, 48; 29/895.21, 895.211, 895.23, 895.3

[56] References Cited

U.S. PATENT DOCUMENTS

| | | | |
|---|---|---|---|
| 4,139,145 | 2/1979 | Moore | 228/5.7 |
| 5,169,051 | 12/1992 | Noé | 228/5.7 |
| 5,312,025 | 5/1994 | Rottger | 228/5.7 |
| 5,379,693 | 1/1995 | Hoffman et al. | 101/375 |

FOREIGN PATENT DOCUMENTS

| | | | |
|---|---|---|---|
| 2547873 | 4/1977 | European Pat. Off. . | |
| 554542 | 8/1983 | European Pat. Off. . | |
| 326994 | 8/1989 | European Pat. Off. . | |
| 2700118 | 7/1977 | Germany . | |
| 2949095 | 3/1981 | Germany . | |
| 3828341 | 10/1989 | Germany | 219/121.64 |
| 4140768 | 6/1993 | Germany . | |
| 96385 | 5/1985 | Japan | 219/121.64 |
| 121089 | 6/1985 | Japan | 219/121.64 |
| 255782 | 11/1986 | Japan | 219/121.64 |
| 276794 | 12/1986 | Japan | 219/121.64 |
| 327388 | 11/1992 | Japan | 219/121.64 |

*Primary Examiner*—Stephen Funk
*Attorney, Agent, or Firm*—Cohen, Pontani, Lieberman, Pavane

[57] ABSTRACT

A sleeve-shaped printing sleeve for a form cylinder of a printing machine is fabricated from a blank of metallic material by cutting the blank to a width corresponding to the form cylinder and to an intermediate length which exceeds the circumference of the intended printing form cylinder. Additionally, the blank is provided with aligning indicia in the regions between each edge of the intermediate-length blank and the corresponding edge to be defined by cutting. Thus, these regions lie outside of the printing area. The blank is bent circularly, held in exact register in a bending/welding device, and cut to the length required for the intended form cylinder by laser beam cutters. As a result of this cutting operation, two waste pieces are produced. The waste pieces are removed and the now defined plate edges forming the beginning and end of the printing form are positioned opposite one another without overlap and welded together, preferably by a laser.

5 Claims, 3 Drawing Sheets

PROCESS FOR FABRICATING A SLEEVE SHAPED PRINTING FORM

BACKGROUND OF THE INVENTION

1. Field of the Invention

This invention relates to a process for the manufacture of a sleeve-shaped printing form for a printing machine form cylinder, and more particularly, to a process for fabricating, from a plate-shaped blank, a printing form sleeve having a continuous circumferential surface. Printing forms fabricated in accordance with the present invention are especially useful for offset printing applications.

2. Description of the Prior Art

A printing form sleeve for offset printing produced by a conventional process is disclosed in German Patent Application P41 40 768. This sleeve can be used in combination with a form cylinder having no grooves or clamping segments which is already known, e.g., from German Patent DE-PS 27 00 118. For this purpose, a plate is cut to dimensions corresponding to the circumference and width of the form cylinder and is provided, using a plate punch, with a register device in the form of a peg-hole system. The blank which conforms to the required dimensions must be cut to length in an accurate manner. This is done with special plate shears. The blank is bent or otherwise manipulated to form a tubular shape, and is clamped in a welding device with the contiguous edges in exact alignment or registration. The contiguous edges of the plate thus forming the beginning and end of the printing form can then be welded together longitudinally, preferably by means of a neodymium-YAG laser.

The prior German Patent Application P 43 11 078 further discloses a device in which the plate which has been cut to size need only be inserted, whereupon the plate can be bent into a sleeve shape and the plate edges forming the beginning and end of the printing form can be positioned in exact register for the purpose of laser welding. Disadvantageously, the plate shears used to cut the plate-shaped blank to the desired length, which cutting must be carried out very accurately, are very expensive.

Accordingly, it is an object of the present invention to provide an improved printing form fabrication process in which the need for plate shears is obviated and in which accurate cutting of the plate-shaped blank to the required dimensions is ensured.

It is a further object of the present invention to provide a printing form which can be manufactured in a simple and economical manner.

SUMMARY OF THE INVENTION

The aforementioned objects, as well as others which will become apparent to those skilled in the art upon review of the teachings set forth herein, are achieved by a process in which a sleeve-shaped printing sleeve for a form cylinder of a printing machine is fabricated from a blank of metallic material by cutting the blank to a width corresponding to the form cylinder and to an intermediate length which exceeds the circumference of the intended printing form cylinder. The blank is provided with aligning indicia in the regions between each edge of the intermediate-length blank and the corresponding edge to be defined by cutting. Thus, these regions lie outside of the printing area.

The blank is bent circularly, held in exact register in a bending/welding device, and cut to the length required for the intended form cylinder by laser beam cutters. As a result of this cutting operation, two waste pieces are produced. The waste pieces are removed and the now defined plate edges forming the beginning and end of the printing form are positioned opposite one another without overlap and welded together, preferably by a laser.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

An understanding of the individual process steps of the present invention will be facilitated by the detailed description of an illustrative embodiment set forth herein in combination with reference to the annexed drawings, in which.

DETAILED DESCRIPTION OF THE PRESENTLY PREFERRED EMBODIMENTS

Figure 1:
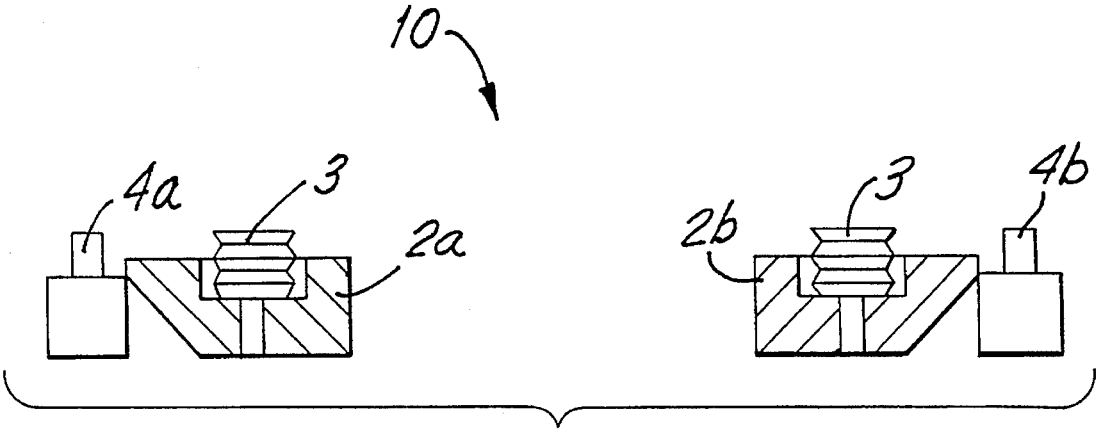
FIG. 1 depicts the (empty) device for bending the plate-shaped blank.

With reference now to FIGS. 1–6, there is shown in cross section a device 10 for bending and welding a plate-shaped blank, such as blank 1. As best seen in FIG. 1, device 10 is constructed in a conventional manner and includes elongated gripping devices 2*a*, 2*b* for maintaining the blank 1 in a predetermined position. Illustratively, the gripping devices are in the form of suction strips. Accordingly, each gripping device as 2*a*, 2*b* includes a plurality of adjustable length vacuum suction members 3 which are integrated therein so as to be distributed along the entire length at closely spaced intervals for the purpose of holding the blank 1.

Figure 2:
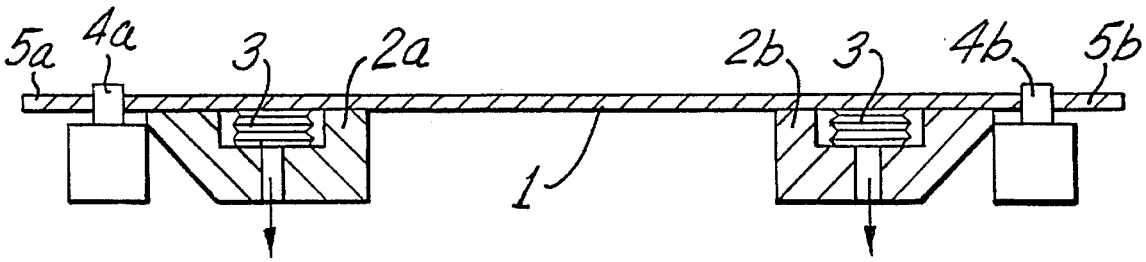
FIG. 2 depicts the insertion of the plane blank in exact register into the device for bending.

As discussed above, the blank 1 is cut from a metallic material, generally in the shape of a strip, to form a plate having a width conforming to that of the form cylinder for which it is intended. For a purpose which will be explained later, however, the length of blank 1 must be greater than the given circumference of the intended printing form. A suitable plate punch (not shown) provides the blank 1 with edge aligning indicia in the form of a system of spaced peg-holes located proximate the plate edges 5*a*, 5*b* to be connected which is located outside of the provided printing area. Both the edge aligning indicia and the edges 5*a*, 5*b* are located in a region of the blank 1 which is outside the intended printing area of the plate. As best seen in FIG. 2, the gripping devices 2*a*, 2*b* may be outfitted with corresponding peg registers 4*a*, 4*b* which are insertable into the peg-holes to center the plate-shaped blank 1 in exact registration with bending device 10. In this regard, it will be noted that although the edge aligning indicia of the illustrative embodiment depicted in FIGS. 1–6 comprise apertures, it will, of course, be readily appreciated by those skilled in the art that any kind of stops, marks or other means for ensuring that the plate edges 5*a*, 5*b* are fastened and aligned in the welding device in an accurately positioned manner may be utilized.

FIG. 2 shows the insertion of the planar blank 1 into the illustrative bending device 10 in exact register. As will be readily appreciated by those skilled in the art, when the pegs 4*a*, 4*b* of the register device are fitted into the peg-hole system of the blank 1, the blank 1 is held fixed in the device in exact register by operation of the adjustable vacuum suction members 3. Of course, in the case of plate-shaped blanks, fastening the blank in exact register can also be achieved without punching in a peg-hole system beforehand. The blank can, for example, be welded in the shape of a sleeve in accordance with subsequent steps of the inventive process by inserting the blank into the welding device with a sufficient projecting or excess length, positioning the two holding strips at a closer distance than that corresponding to the theoretically correct length of the printing form, and then tightening or taking in the plate to the correct length.

Since pretreated aluminum plates are the most common type of printing form used in offset printing, vacuum suction members 3 are used in the embodiment example. If, on the other hand, the plate material is a ferrous metal or metal alloy, it is also possible to use an electromagnetic gripping device to fix the blank in the welding device. As yet another alternative, a mechanical clamping device may be used to maintain the printing form in exact register.

Figure 3:
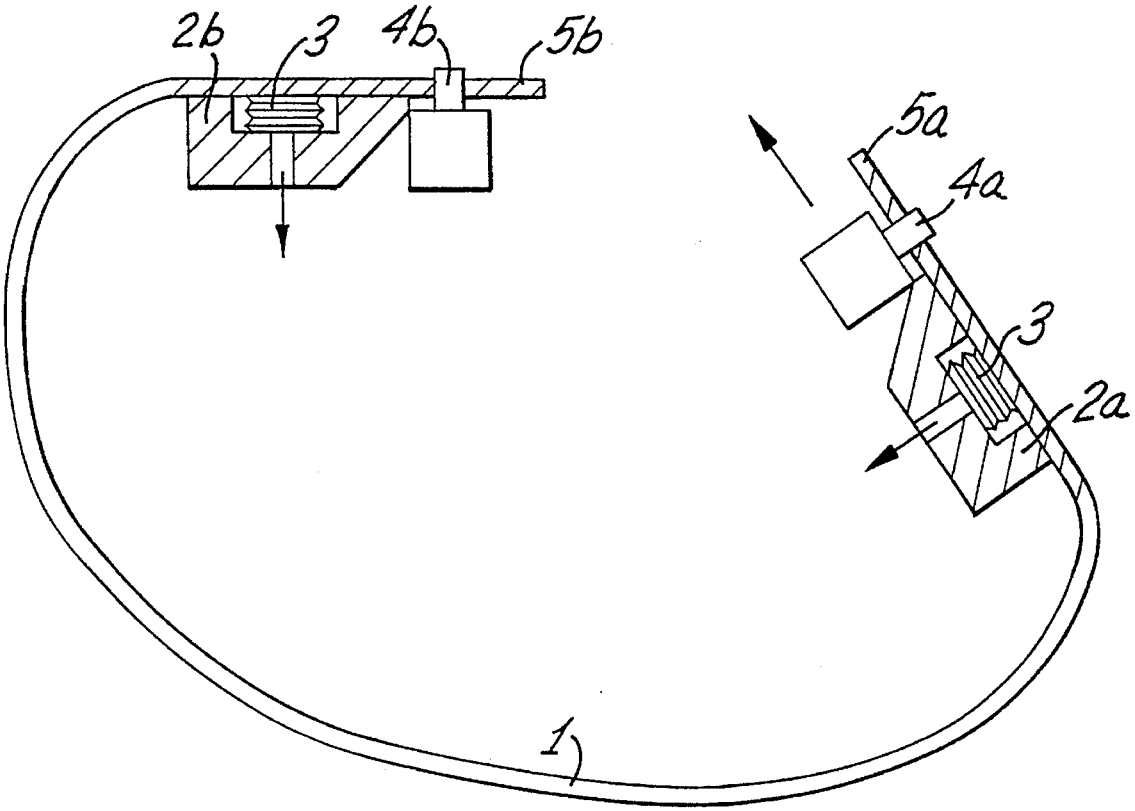
FIG. 3 illustrates the circular bending process.
Figure 4:
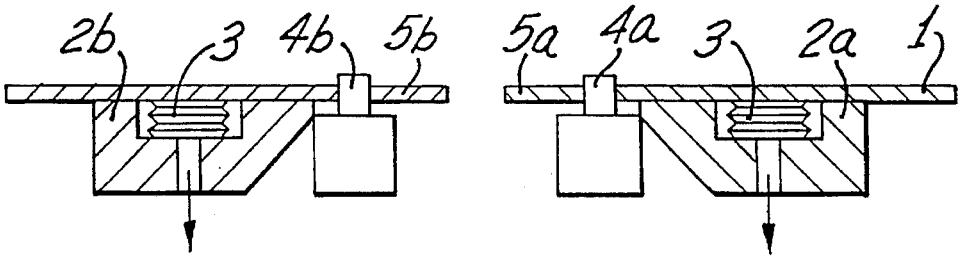
FIG. 4 shows the positioning in exact register of the edges of the blank to be connected.

Once a blank as blank 1 is fixedly positioned in exact register within bending device 10, the blank is bent in a conventional manner by moving the gripping devices along respective paths. FIG. 3 depicts the blank 1 in an intermediate position during bending. Continued movement of the gripping devices and hence, bending of the blank 1, results in the exact alignment of plate edges 5*a*, 5*b* shown in FIG. 4. In accordance with the present invention, a portion of each end of blank 1 is severed (FIG. 5) in order to obtain a plate having a length precisely matched to the circumference of the corresponding form cylinder to which it will be secured. For this purpose, at least one cutting device is utilized. Preferably, two cutting devices, each movable along a predetermined path to produce the desired complementary edge contours, are employed in order to minimize the amount of time required to perform the cutting operation. Illustratively, the respective ends of blank 1 may be cut using first and second laser cutting devices 6*a*, 6*b* which may, in a conventional manner, emit a suitably precise cutting beam as they are moved in, for example, along parallel paths over the blank 1 at a predetermined distance from edges 5*a*, 5*b*. Laser cutting of flat sheets or plates, may be utilized to obtain both simple contours and complicated shapes having sharp or acute corners, is known from the prior art. In conformity to its light properties, the laser beam obeys the laws of optics. Thus, it can be controlled by mirrors and lenses and changed in cross section in virtually any desired manner. The chief advantage of the laser as a cutting device consists in the low degree of thermal damage inflicted on the cut edges, the high cutting speeds with uniform quality, and the possibility of an automated process.

Figure 5:
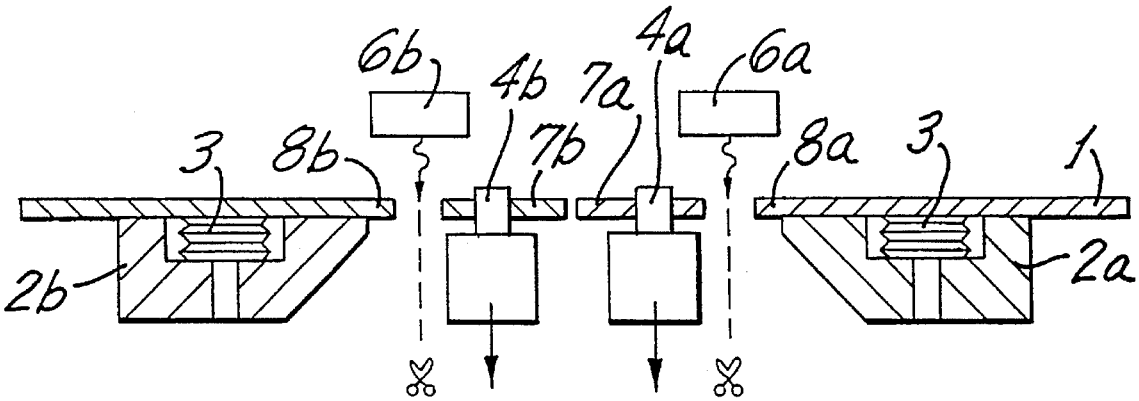
FIG. 5 depicts cutting of the blank to the required length and removal of the waste pieces.
Figure 6:
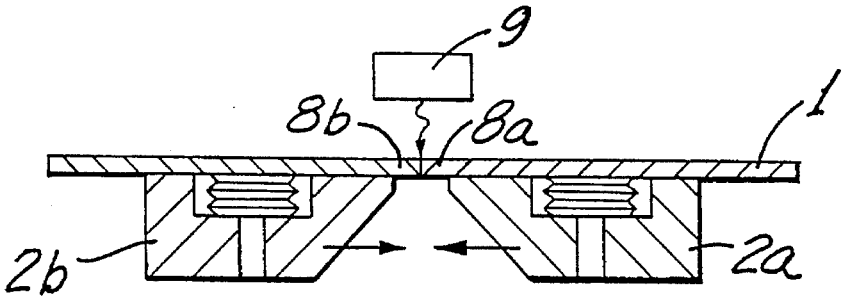
FIG. 6 illustrates joining of the plate edges forming the beginning and end of the printing form without overlap and subsequent welding of the plate edges.

After the cutting process, one or two waste pieces 7*a*, 7*b* resulting from the cutting process are removed from the welding device. Since the pegs 4*a*, 4*b* of the register device are centered in the peg-hole system of the blank 1 and this peg-hole system is located in these waste pieces 7*a*, 7*b*, the latter may be removed simply by swinging out or otherwise retracting the peg registers 4*a*, 4*b* (FIG. 5). As shown in FIG. 6, the plate edges 8*a*, 8*b* forming the beginning and end of the printing form which has been cut to the required length may then be joined without overlap and welded together. Preferably, a precisely focussed laser beam 9 is used for welding. Thus, the application of heat is restricted to a narrow zone and the laser beam can penetrate deeply into the material. Thermal loading and warping of the welded material is negligible in comparison to other thermal methods.

The process of the present invention provides numerous advantages over prior art techniques for fabricating cylindrically shaped printing forms. In contrast to conventional techniques, workpieces which have been punched, but not cut to the required length, are placed in the welding device in exact register and cut to the required dimensions by means of lasers only after being clamped into the welding device. Since the blank is cut to the required dimensions by lasers in the welding device, separate plate shears may be entirely dispensed with. The register punches provided in the plate for holding the plate blank 1 in exact register become superfluous once the plate is fixed by the holding strips 2*a*, 2*b* and can be discarded along with the waste pieces 7*a*, 7*b* after the plate is cut to the required length by the laser. This results in a closed sleeve surface so that no printing media can collect in the punched out portions in a troublesome manner.

A further advantage afforded by the present invention is that laser-cut plate edges 8*a*, 8*b* may be made to conform to one another in an optimum manner due to the affinity of the laser cutting and laser welding processes, resulting in an optimum weld.

The aligning indicia employed by known devices, e.g. marks on the surface of the form cylinder which are brought into alignment with marks on the thin printing form sleeve, can be used for arranging the printing form sleeve on the form cylinder. The sleeve is slipped onto the form cylinder by expanding it with compressed air. When the compressed air is shut off, the printing form clings to the form cylinder in a positive engagement. The coating and exposure of the printing form can be carried out by photochemical means outside the printing machine before the plate-shaped blank is welded or, alternatively, after the printing form sleeve is slipped on by coating and exposing the printing form on the form cylinder.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A process for the manufacture of a sleeve-shaped printing form dimensioned for placement over a form cylinder of a printing machine, comprising the steps of:

providing a plate shaped, metallic print form base having a length greater than a circumference of an intended printing form and a width corresponding to a width of the form cylinder;

bending the print form base to align opposite edges thereof in a bending device;

cutting the print form base to produce at least one waste piece and a final blank having a length corresponding to the circumference of the intended printing form and having first and second aligned opposite edges;

providing the print form base with edge aligning indicia in a region of the base defining the at least one waste piece, prior to said bending step;

positioning, after said cutting step, the first and second aligned opposite edges in contiguous, facing relation without overlap; and welding the first and second aligned opposite edges together to form the printing form.

2. The process according to claim 1, wherein the print form base is held with the opposite edges in exact register and cut by at least one laser beam during said cutting step to form two waste pieces and to thereby form the final blank having the first and second opposite edges in aligned, facing relation.

3. The process according to claim 1, wherein the edge aligning indicia providing step comprises punching peg-holes in regions of the opposite edges thereof, said regions being disposed outside of a printing area of the intended printing form and said peg-holes being dimensioned and arranged to receive peg registers of the bending device when properly aligned therewith.

4. The process according to claim 1, wherein said cutting step is performed using at least one laser beam.

5. The process according to claim 1, wherein said cutting step is performed using a laser beam.

* * * * *